United States Patent [19]

Kaldon et al.

[11] Patent Number: 4,989,838

[45] Date of Patent: Feb. 5, 1991

[54] METALLURGICAL TREATMENT LANCE

[76] Inventors: Richard G. Kaldon, 1293 Greystone Dr., Upper St. Clair, Pa. 15241; William K. Brown, 323 Ridge Point Cir., Bridgeville, Pa. 15017

[21] Appl. No.: 392,056

[22] Filed: Aug. 10, 1989

[51] Int. Cl.[5] ..... C21B 7/16

[52] U.S. Cl. ..... 266/44; 266/225; 266/270

[58] Field of Search ..... 266/270, 225, 44, 265

[56] References Cited

U.S. PATENT DOCUMENTS

| | | | |
|---|---|---|---|
| 3,615,085 | 10/1971 | Bernesmann | 266/225 |
| 4,192,490 | 3/1980 | Nilsson et al. | 266/225 |
| 4,367,868 | 1/1983 | Blom et al. | 266/225 |
| 4,791,978 | 12/1988 | Fishler | 222/602 |

FOREIGN PATENT DOCUMENTS

| | | | |
|---|---|---|---|
| 106822B | 4/1984 | European Pat. Off. . | |
| 1131077 | 11/1987 | Japan . | |
| 2021242 | 11/1979 | United Kingdom | 266/225 |
| 2202317 | 9/1988 | United Kingdom . | |

*Primary Examiner*—S. Kastler

*Attorney, Agent, or Firm*—Sigalos, Levine & Montgomery

[57] ABSTRACT

A lance adapted for metallurgical treatment comprising an elongated tube-shaped member having a refractory coating thereon and a sleeve of carbon bonded refractory fitted about the tube-shaped member at the slagline to protect the slagline region thereof.

12 Claims, 1 Drawing Sheet

METALLURGICAL TREATMENT LANCE

BACKGROUND OF THE INVENTION

This invention relates to steel and iron-making injection lances, and more particularly to such lances which are protected by refractory concrete Steel and iron-making injection lances protected by refractory concrete have heretofore been known, illustrative of which are those which are generally offered for sale by Inland Enterprises, Inc. of Cleveland, Ohio. Typically, such lances comprise an inner steel pipe through which injected gasses pass for injection into molten steel or iron and a refractory concrete coating which is provided to protect the steel piping from the intense heat associated with molten steel.

In certain commercial applications, injection lances are inserted into the molten steel or iron bath through the slag cover that usually floats on top of the liquid bath and which serves to partially protect the molten metal from the environment. In other applications, care is taken to prevent contact between the environment and the molten metal which could cause undesirable gas incorporation or reoxidation of the metal.

It has been found that refractory coatings as typically employed on steel-making lances undergo preferential erosion at the slagline due to a reaction between the basic slag on the surface of the molten steel and the acidic alumina material within the concrete coating of the lance. Such reaction dissolves the concrete, thus creating a slagline cut which renders the lance unusable after a short period of time even though other areas of the lance (i.e., tip and top) have sufficient remaining concrete thickness to provide additional service. As an example, treatment lances with conventional exterior refractory concrete coatings typically are usable under service conditions for only about 160 minutes, at which time the lance is removed from service due to slagline cut and then discarded. Obviously, it would be highly desirable to extend the life of such lances since typical steel mills may employ 1,000 or more each year at a cost of $1,000 or more per lance.

SUMMARY OF THE INVENTION

It has been discovered that certain materials act cooperatively to interface with refractory concrete of the type employed for lance coatings while at the same time providing a high degree of resistance to slagline erosion. Accordingly, in accordance with the principles of the invention, a sleeve of such material is affixed to the exterior of the lance at a location where the slagline level occurs when the lance is in place in the molten steel or iron, and such sleeve advantageously reduces slagline wear by a substantial degree, thereby adding extensively to the life of the lance. In addition, such sleeves can be made readily replaceable so that in the event a particularly erosive condition is encountered, after a period of use, the lance may be withdrawn and the sleeve replaced so as to provide extended useful life equal to or greater than that of the refractory concrete in areas other than the slagline.

OBJECTS AND FEATURES

It is one general object of this invention to improve steel and iron-making lances.

It is another object of the invention to extend useful life of such lances.

It is yet one further object of the invention to provide for ready replaceability of an important component of a steel or iron-making lance.

Accordingly, in accordance with one feature of the invention, the slagline region on a lance is identified and a protective sleeve having compatible characteristics to steel or iron-making slag is installed at the lance slagline region, thereby providing a high degree of resistance to slagline erosion.

In accordance with another feature of the invention, such sleeve is made removable and replaceable so as to facilitate extended utilization of the lance to achieve markedly increased life expectancy.

In accordance with still another feature of the invention, the sleeve is made in sections so as to facilitate installation and removal.

In accordance with yet another feature of the invention, the preferred sleeve is made of carbon bonded magnesite or carbon bonded alumina, thereby achieving the aforementioned material compatibility and facilitating fabrication installation and use.

These and other objects and features of the invention will be apparent from the following detailed description by way of a preferred embodiment with reference to the drawings.

DETAILED DESCRIPTION

Figure 1:
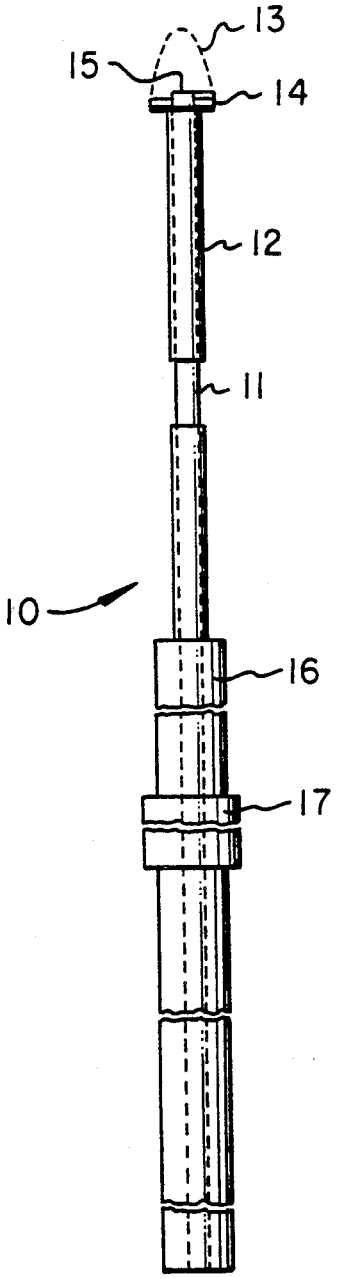
FIG. 1 is an elevation view depicting a typical steel or iron-making lance in accordance with the principles of the invention.

Now turning to the drawing, and more particularly to FIG. 1 thereof, it will be observed that there is therein depicted a steel or iron-making lance 10 constructed in accordance with the principles of the invention. Such lance comprises a tubular steel interior 11 onto which there has been applied a conventional refractory concrete coating 16. As is known to those skilled in the art, conventional refractory concrete coatings typically utilized on lances are substantially acidic and have an alumina content typically ranging from about 70 to about 90 weight percent. Such refractory concrete is applied to steel pipe 11 by conventional techniques well known in the refractory shape making arts.

At the upper end of the lance 10, there conventionally is provided a short length of chain 13 which serves to provide a means for hoisting and positioning the lance. Also, at the upper end of the lance there typically is a collar 14 which is affixed to the upper end 15 of pipe 12 by any suitable means such as clamping or shrink fitting. As will be observed from the figure, collar 14 provides a convenient interface between chain 13 and the upper end 15 of pipe 11. Collar 14 may also provide a useful means for affixing a plug to seal the exposed upper end 15 of pipe 11 and/or to protect any threads or other vulnerable surfaces that may exist, depending upon the particular construction of the lance.

At the lower end of the lance 10, there is a substantially thicker section of refractory concrete 16 which surrounds tubular steel interior 11. This section 16 may vary in length and in thickness, depending upon the specific application in which the lance is to be employed. As will be evident from the drawing, this thicker section extends from the lower end of square steel tube exterior 12 vertically to a point substantially below the intended location of the slagline when the lance is in use. Typically, the length of this thicker section 16 is approximately 14 feet, while the length of the upper portion of the lance is approximately 12 feet.

As previously mentioned, in accordance with the principles of the invention, a refractory collar 17 is installed around pipe 11 at the region of the expected slagline. This collar which typically is about 2 feet in length and about 12 inches in diameter, is installed and affixed to the lance pipe 11 as is shown in more detail in FIG. 2. There, it will be observed that collar 17 is comprised of four sections, 17*a*–17*d*, which are snugly fit together so as to occupy the recessed region 18 of refractory concrete layer 16.

Figure 2:
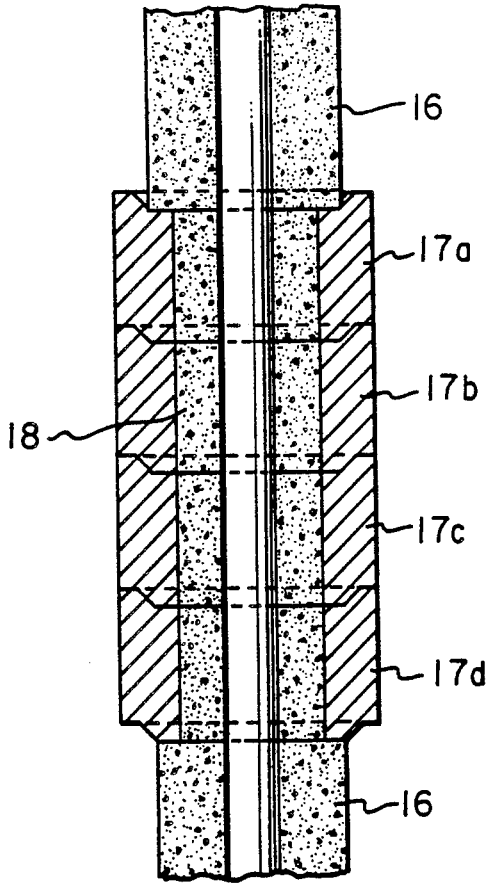
FIG. 2 is an enlarged view depicting that portion of the lance wherein the aforementioned sleeve is installed.

Although collar 17 is shown as comprising four sections, 17*a*–17*d*, it will be evident to one skilled in the art that the collar could be formed in one unitary section. However, for ease in installation and maintenance, it has been found preferable to use a plurality of sections as shown in FIG. 2. To facilitate installation, each of sections 17*a*–17*d* is made in at least two parts as if the members were slit vertically, thus permitting ready removal and replacement.

As hereinabove described, the collar is comprised of carbon-bonded or carbon-bonded pitch impregnated refractory, preferably carbon-bonded magnesite or carbon-bonded alumina. The preferred magnesia content of the sleeve is above 80 weight percent with a residual being of up to 20 weight percent carbon with a preferential composition being near five weight percent. However, it should be understood that a wide range of carbon-bonded magnesite refractories ranging from 50 to 99 weight percent magnesia and trace to 50 weight percent carbon would offer service performance advantage over cement-bonded high alumina concrete composition.

For the magnesite sleeve, the magnesia may be in the form of sintered grain, fused grain or a combination of these two grains or in the form of sintered or fused spinel grain. The residual carbon bond may be derived from resin, tar or pitch, or a combination of these carbon sources. For the alumina sleeve, the preferred alumina content of the sleeve is above 70 percent with a residual carbon greater than 10 percent. However, it is understood that a wide range of carbon-bonded alumina refractories (50 to 90 weight percent alumina and trace to 50 weight percent carbon) offers service performance advantage over cement-bonded high alumina concrete compositions. The alumina of the alumina sleeve may be in the form of sintered grain, fused grain, or a combination of these two. The residual carbon may be derived from resin, tar, pitch, or a combination thereof. These materials are mixed together by conventional mixing and then are preferably formed by power pressing. However, the sleeve members may also be rammed, cast, injection molded, or isopressed.

The invention will be further described in connection with the following examples which are set forth for purposes of illustration only.

EXAMPLE 1

A carbon bonded high alumina sleeve was formed from the mix set forth below. The ingredients were admixed, pressed into the desired sleeve shape, and cured at a temperature of 250°–300° C. The shape was tested and the results are set forth below.

| | |
|---|---|
| Tabular Alumina-6 mesh | 61% |
| Tabular Alumina-325 mesh | 10 |
| Reactive Alumina-325 mesh | 10 |
| Silicon Carbide-200 mesh | 5 |
| Flake Graphite | 8 |
| Powdered Silicon | 3 |
| Powdered Aluminum | 3 |
| Plus Addition | |
| Phenolic Resin | 4.5 |
| Bulk Density, pcf | 188 |
| Coked Properties | |
| Bulk Density, pcf | 183 |
| % Apparent Porosity | 14.3 |
| Apparent Specific Gravity | 3.42 |
| Modules of Rupture, psi | |
| At Room Temperature | 4910 |
| At 2000° F. (Reducing) | 4180 |
| Crushing Strength at 2800° F., psi | 6050+ |

EXAMPLE 2

A sleeve was formed and tested as in Example 1, but the mix used to form the sleeve was a carbon bonded magnesite. The mix and test results are set forth below.

| | |
|---|---|
| Mix: | |
| Deadburned Magnesite | |
| 4 + 10 mesh | 29% |
| 10 + 35 mesh | 34 |
| Ball Mill Fines | 18 |
| Flake Graphite | 17 |
| Powdered Aluminum | 2 |
| Plus Additions: | |
| Phenolic Resin Bond | 3.5 |
| Bulk Density, pcf: | 183 |
| Coked Properties | |
| Bulk Density, pcf: | 174 |
| Apparent Porosity, % | 9.45 |
| Apparent Specific Gravity: | 3.08 |
| Modules of Rupture, psi | |
| At Room Temperature: | 2270 |
| At 2000° F.: | 1770 |
| Crushing Strength at 2800° F., psi | 3140 |

It will now be evident that there has been described herein an improved lance construction which exhibits significant advantages over the corresponding prior art. Although the inventive concepts hereof have been illustrated by way of a preferred embodiment, it will be evident to those skilled in the art that adaptations and modifications may be employed without departing from the spirit or scope of the invention. Thus, for example, the carbon-bonded refractory sleeve could be extended the full length of the lance lower portion, although such would incur significant additional expense since carbon bonded refractories generally are more expensive than conventional refractory concrete. Likewise, it is understood that both carbon bonded compositions illustrated above may contain other powdered metals (for example, magnesium) which impart to the composition improved oxidation resistance.

The terms and expressions employed herein have been used as terms of description and not of limitation; and there is no intent in the use thereof to exclude equivalents, but on the contrary, it is intended to include any and all equivalents, adaptations and modifications that can be employed without departing from the spirit and scope of the invention as described in the specification and claims herein.

What is claimed is:

1. A steel or iron-making lance comprising an elongated member having a first end at one extremity of said member and another end at the opposite extremity of said member, said elongated member having a principal axis extending between said ends and defining the elongated dimension of said member, an aperture essentially parallel to said elongated dimension and extending from a pre-determined position adjacent said one end of said elongated member in the direction of said axis to said other end of said elongated member, said elongated member having an exterior surface slagline region for contacting the slagline of molten steel or iron when said lance is in use, a refractory coating on the exterior of said member, and a detachable sleeve mated to the exterior surface of said refractory coating to cover said slagline region and to protect said slagline region when said lance is in use.

2. A steel or iron-making lance according to claim 1 in which said elongated member is essentially cylindrical.

3. A steel or iron-making lance according to claim 1 in which said detachable sleeve includes a plurality of sections.

4. A steel or iron-making lance according to claim 3 in which said plurality of sections are adapted to form said sleeve around said elongated member without sliding therealong.

5. A steel or iron-making lance according to claim 3 in which said at least two of said plurality of sections are semi-circular in shape thereby when adjoined about said elongated member, form a complete ring around said slagline region of said elongated member.

6. A steel or iron-making lance according to claim 1 in which said elongated member is principally made of high alumina content refractory.

7. A steel or iron-making lance according to claim 1 in which said detachable sleeve is made of carbon bonded magnesite.

8. A steel or iron-making lance according to claim 1 in which said detachable sleeve is made of carbon bonded alumina.

9. A steel or iron-making lance according to claim 6 in which said detachable sleeve is made of carbon bonded magnesite.

10. A steel or iron-making lance according to claim 6 in which said detachable sleeve is made of carbon bonded alumina.

11. A steel or iron-making lance comprising a steel pipe having a first end and a second end opposite said first end, said pipe having a principal axis extending between said ends and defining the elongated dimension of said pipe; an aperture within said steel pipe essentially parallel to said axis and extending from a predetermined position adjacent said first end in the direction of said axis to said second end, an alumina refractory coating on the exterior of said pipe thereby to form an elongated member having an exterior surface of alumina refractory material including a slagline region for contacting the slagline of molten steel or iron when said lance is in use, and a detachable sleeve mated to the exterior surface of said elongated member to cover said slagline region and to protect said slagline region when said lance is in use.

12. A method of making a steel or iron-making lance comprising the steps of selecting a predetermined length of pipe, coating the exterior surface of said pipe with a refractory coating of high alumina content refractory to form a first coating; locating a predetermined region on the outer surface of said first coating for use as a slagline when said lance is in use; and detachably mating to said predetermined region on said outer surface of said first coating a slagline protection member.

* * * * *